US005779517A

United States Patent [19]

Clarke

[11] Patent Number: 5,779,517

[45] Date of Patent: Jul. 14, 1998

[54] CONSTRUCTION KIT

[76] Inventor: David John Clarke, 30 Kingsbrook Rd., Bedford MK42 OBH, England

[21] Appl. No.: 788,712

[22] Filed: Jan. 23, 1997

[30] Foreign Application Priority Data

Jan. 26, 1996 [GB] United Kingdom ..... 9601573

[51] Int. Cl.[6] ..... A63H 33/08; A63H 33/06

[52] U.S. Cl. ..... 446/108; 446/110; 446/118

[58] Field of Search ..... 446/108, 110, 446/114, 116, 118, 127

[56] References Cited

U.S. PATENT DOCUMENTS

| | | | |
|---|---|---|---|
| 1,425,425 | 8/1922 | Varnuska | 446/110 |
| 1,551,666 | 9/1925 | Jensen et al. | 446/110 |
| 1,569,066 | 1/1926 | Beiger | 446/108 |
| 3,132,443 | 5/1964 | Kuhn | 446/110 |
| 3,996,693 | 12/1976 | Walmer | 46/19 |
| 4,270,302 | 6/1981 | Dandia | 446/110 |
| 4,306,371 | 12/1981 | Walmer et al. | 446/110 |
| 5,036,634 | 8/1991 | Lessard et al. | 52/79.1 |

FOREIGN PATENT DOCUMENTS

| | | | |
|---|---|---|---|
| 133178 | 12/1932 | Australia | 446/110 |
| 294636 | 10/1991 | German Dem. Rep. | 446/110 |
| 486085 | 8/1954 | Italy | 446/110 |
| 1250711 | 10/1971 | United Kingdom . | |
| 2042017 | 9/1980 | United Kingdom | 446/110 |

*Primary Examiner*—Robert A. Hafer
*Assistant Examiner*—Laura Fossum
*Attorney, Agent, or Firm*—Edwin D. Schindler

[57] ABSTRACT

A construction kit comprises a base panel having a peripheral frame, a rear wall for locating on the base panel against a rear portion of the peripheral frame, and side walls. The side walls have rear edges for engagement in grooves provided at opposite ends of the rear wall, and studs at the bottom of their front edges for engaging in holes in the top face of the peripheral frame of the base panel.

8 Claims, 3 Drawing Sheets

CONSTRUCTION KIT

BACKGROUND OF THE INVENTION

The present invention relates to a construction kit for a toy or model building.

There are many situations in which children enjoy constructing toy or model buildings, and using these for play. A number of construction kits have been proposed and used hitherto, but I have now devised an improved construction kit which offers a number of advantages.

SUMMARY OF THE INVENTION

Thus, in accordance with the present invention, there is provided a construction kit which comprises a base panel having a peripheral frame, a rear wall for locating on the base a panel against a rear portion of the peripheral frame, and side walls having rear edges for engagement in grooves provided at opposite ends of the rear wall and studs at the bottom of their front edges for engaging in holes in the top face of said peripheral frame.

The construction kit pref erably further comprises an upper panel also having a peripheral frame within which the top edges of the rear and side walls locate. Preferably the peripheral frame of the upper panel is formed with holes to receive studs at the top of the front edges of the side walls.

Preferably the rear wall is provided with uprights of enlarged cross-section at its opposite ends, in which the grooves to receive the rear edges of the side walls are formed.

Preferably the front edges of the side walls are provided with uprights of enlarged cross-section, the ends of which are provided with the afore-mentioned studs.

Preferably the kit comprises one or more internal walls, which the user can use at his option: preferably each internal wall has a plain rear edge to fit into a groove with which the rear wall is provided intermediate its opposite edges; preferably each internal wall is provided, at its front edge, with an upright of enlarged cross-section, the ends of which are provided with studs for engaging in selected holes in the frames of the base and upper panel.

Preferably the kit comprises additional walls and panels for forming one or more further storeys to the building.

It will be appreciated that the kit enables a building to be constructed quickly and easily, and subsequently taken apart equally quickly and easily. The building is however particularly stable when constructed. Preferably the front of the building remains open, for ease of access to its interior.

Preferably the kit enables a building to be constructed of selected size and design, according to the user's choice. The kit is made up of flat walls and panels and can therefore be packed in a flat and compact manner.

The walls and panels may be made of any desired material, although wood is particularly preferred.

An embodiment of the present invention will now be described by way of example only and with reference to the accompanying drawings.

DETAILED DESCRIPTION OF THE PREFERRED EMBODIMENT

Figure 1:
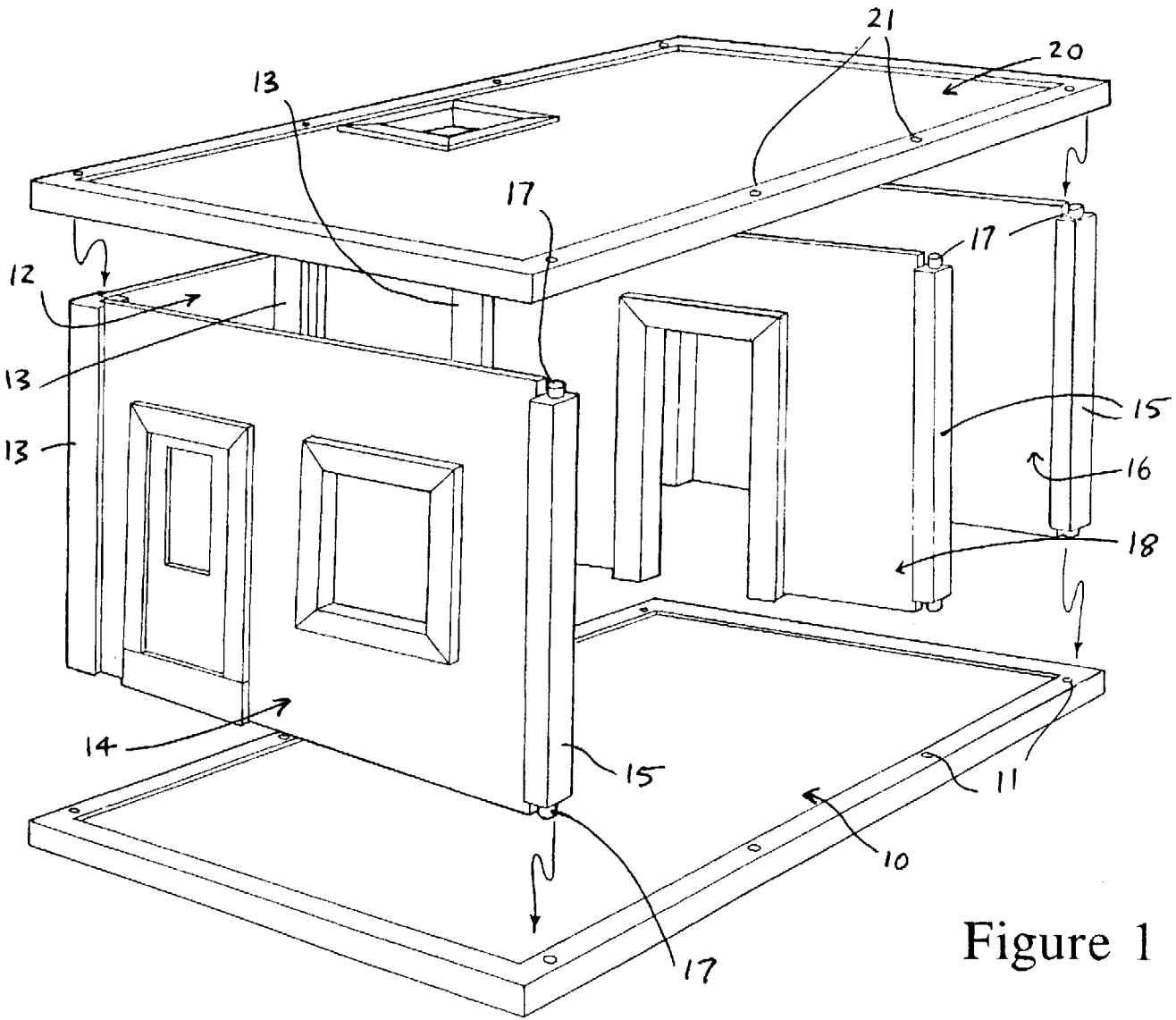
FIG. 1 is a view of a building in the course of construction from a kit in accordance with this invention.
Figure 2:
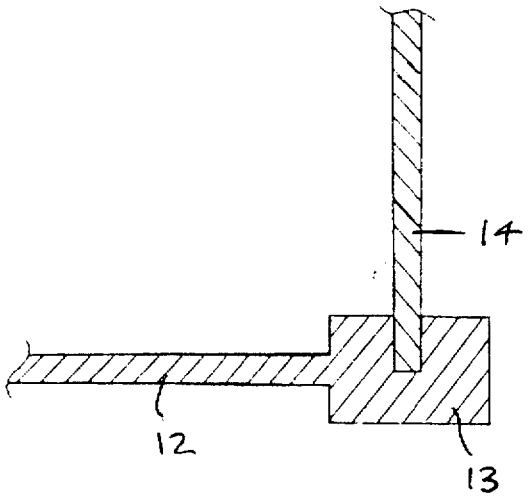
FIG. 2 is a sectional view to show an interconnection between a side wall and the rear wall of the building of FIG. 1.
Figure 3:
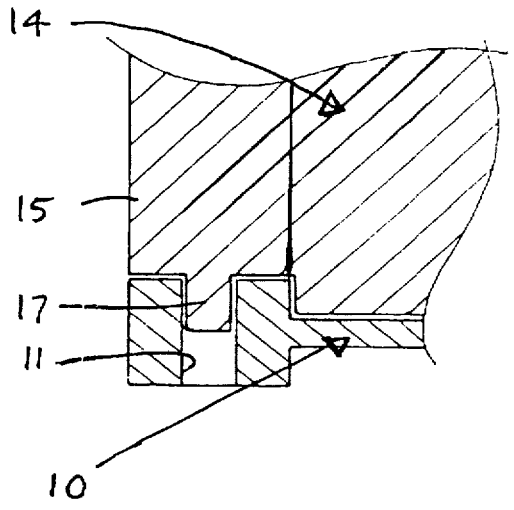
FIG. 3 is a sectional view to show an interconnection between a side wall and the peripheral frame of the base panel of the building.

Referring to FIG. 1, a building is shown in the course of construction: a base panel 10, a rear wall 12, side walls 14,16, an internal wall 18 and an upper panel 20 are shown. Each of the base and upper panels 10,20 has a peripheral frame which is thicker than the panel itself: each of these frames is formed with a series of through-holes 11,21 spaced apart along its front and rear. The rear wall 12 is provided with an upright 13 of enlarged cross-section along its opposite end edges, and with similar uprights intermediate those end edges; each such upright 13 is formed with a groove in its front face, as shown for example in FIG. 2. The side walls and the internal wall 18 have plain rear edges for engagement in the grooves of the uprights 13 of the rear wall 12, also as shown in FIG. 2. The front edges of the side walls 14,16 and internal wall 18 are provided with enlarged cross-section uprights 15, the ends of which terminate short of the top and bottom edges of the side walls and are provided with projecting studs 17.

In constructing a building, and for example as shown in FIG. 1, the rear wall 12 is stood on the base panel 10 and located against the rear edge portion of the peripheral frame and between the opposite side edge portions of that frame. The opposite side walls 14,16 have their rear edges engaged in the grooves of the uprights 13 at the opposite ends of the rear wall 12, and stand on the base panel 10 against the side edge portions of the peripheral frame: further, the studs 17 at the bottom ends of the uprights 15 of the side walls 14,16 are engaged in respective holes 11 of the peripheral frame. The internal wall 18 is similarly stood on the base panel 10 with its plain rear edge engaged in one of the uprights 13 intermediate the opposite ends of the rear wall, and the stud 17 at the bottom of its upright 15 is engaged in a corresponding hole 11 of the peripheral frame of the base panel 10. The upper panel 20 is fitted over the top of the above-described construction, with the top edges of the rear, side and internal walls located within the peripheral frame of the upper panel and the studs 17 of the side and internal walls engaged in respective through-holes 21 of the peripheral frame of the upper panel.

Figure 4:
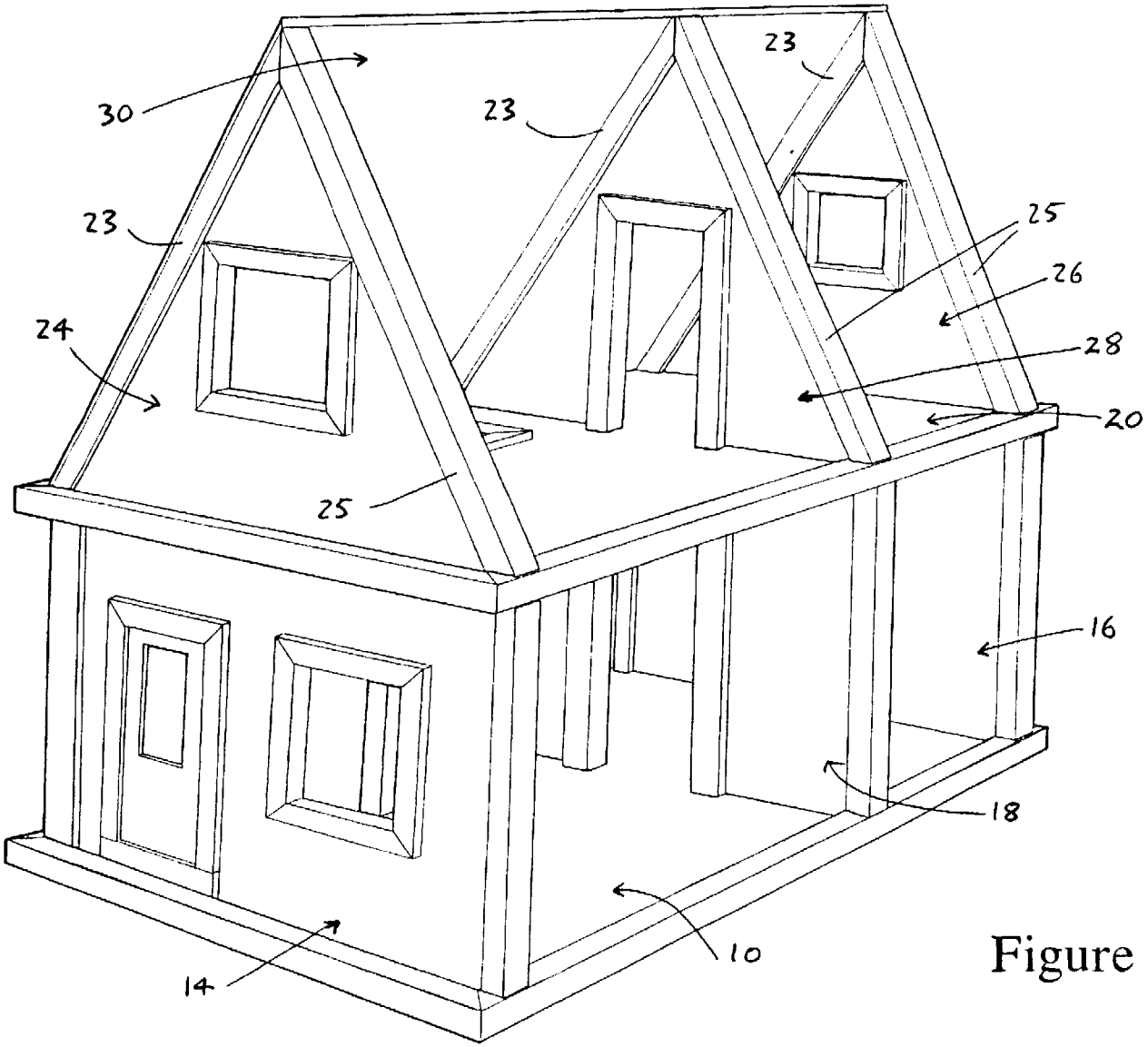
FIG. 4 is a view of the building of FIG. 1 when completed.

FIG. 4 shows the building when completed by an upper storey, comprising gable end walls 24,26, an internal wall 28 and a rear roof panel 30. The end and internal walls have inclined rear edges which are plain and fit into grooves in ribs 23 of the roof panel 30: the end and internal walls have inclined front edges provided with ribs 25 having studs (not shown) at their bottom ends, fitting into respective holes 21 of the peripheral frame of the panel 20. It will be appreciated that the walls 24,26,28 and roof panel 30 locate with the panel 20 in the same manner as the walls 12,14,16 and 18 locate with the panel 10.

It will be appreciated that the building shown is of stable construction and can be quickly put together and taken apart. The kit preferably comprises a number of alternative side and internal walls: the use of the internal walls is optional. The kit preferably comprises additional walls and panels from those shown, so that buildings of different designs and different numbers of storeys can be constructed.

I claim:

1. A construction kit for a toy or model building, said construction kit comprising:

a base panel having a top surface, a front edge, a rear edge, opposite side edges each extending from said front edge to said rear edge, and a frame extending around said edges of said base panel and having a top face which is raised relative to said top surface of said base panel, and an inner edge adjoining said top surface of said base panel, said top face of the frame being formed with a plurality of holes adjacent said front edge of said base panel;

a rear wall having a bottom edge dimensioned and arranged for resting on said top surface of said base panel with said rear wall abutting said inner edge of said frame adjacent said rear edge of said base panel between said side edges, said rear wall having opposite side edges and being formed with grooves adjacent said opposite side edges; and, two side walls having respective bottom edges dimensioned and arranged for resting on said top surface of said base panel and with respective said side walls abutting said inner edge of said frame adjacent said opposite side edges of said base.panel, each said side wall having a rear edge dimensioned and arranged for engagement in a respective said groove of said rear wall, a front edge, and a stud projecting from said bottom edge of said side wall dimensioned and arranged for engagement in a hole of said plurality of holes in said top face of said frame.

2. The construction kit according to claim 1, wherein each of said rear wall and said side walls further comprises a top edge, and said construction kit further comprises an upper panel having an undersurface, front and rear edges, opposite side edges extending between its said front and rear edges, and a raised frame extending around said edges of said upper panel and having an inner edge adjoining said undersurface of said upper panel, said upper panel fitting with its undersurface resting on the top edges of said rear wall and said side walls with said rear and side walls abutting said inner edge of said frame of said upper panel respectively adjacent said rear and opposite side edges of said upper panel.

3. The construction kit according to claim 2, wherein said frame of said upper panel includes a plurality of holes and said side walls include studs projecting from their said top edges adjacent their said front edges, for engagement in respective said plurality of holes of said frame of said upper panel.

4. The construction kit according to claim 1, wherein said rear wall has a uniform thickness between its side edges, with said side edges having integral uprights of greater thickness, said integral uprights being formed with grooves for receiving said rear edges of said side walls.

5. The construction kit according to claim 1, wherein said side walls have a uniform thickness and are provided, adjacent their said front edges, with integral uprights of greater thickness, said integral uprights having a top end and a bottom end with studs projecting from said top end and said bottom end.

6. The construction kit according to claim 2, further comprising at least one internal wall having a bottom edge for resting on said top surface of said base panel and front and rear edges, said rear wall being formed, intermediate its said opposite side edges, with an upright groove for receiving said rear edge of said internal wall.

7. The construction kit according to claim 6, wherein said internal wall has a uniform thickness and is provided, adjacent its front edge, an integral upright of greater thickness and having top and bottom ends which are provided with projecting studs for engagement in selected holes of said plurality of holes in said frames of said base panel and said upper panel.

8. The construction kit according to claim 1, further comprising at least one internal wall having a bottom edge for resting on said top surface of said base panel and front and rear edges, said rear wall being formed, intermediate its said opposite side edges, with an upright groove for receiving said rear edge of said internal wall.

* * * * *